United States Patent [19]

DeVitis

[11] Patent Number: 4,766,635

[45] Date of Patent: Aug. 30, 1988

[54] INTERIOR EDGE-EDGER

[76] Inventor: Louis DeVitis, R.D. #1, Box 258-A, Hightstown, N.J. 08520

[21] Appl. No.: 140,737

[22] Filed: Jan. 4, 1988

[51] Int. Cl.[4] ..... B28B 17/00

[52] U.S. Cl. ..... 15/235.4; 15/235.7; 425/458

[58] Field of Search ..... 15/235.3–235.8, 15/105.5; 425/458

[56] References Cited

U.S. PATENT DOCUMENTS 2,730,756 1/1956 Greene ..... 425/458

3,045,271 7/1962 Cinotti ..... 15/235.8

*Primary Examiner*—Edward L. Roberts

*Attorney, Agent, or Firm*—Ira M. Adler

[57] ABSTRACT

A hand tool for forming the interior edge of a cementious surface. The tool which consists of a flat inflexible rectangular plate shaped such that shorter leading and trailing edge curve upward, and one of the longer edges has a central portion curving outward and downward, and with the length of the right and left non-curving portion of the edge being the same as the leading and trailing edges. With this configuration, the mason slides the tool along the edge of the cement surface and reaches an intersecting interior corner, the tool is lifted and run along the adjacent edge until corner is reached. The tool permits a mason less skilled in the mason art to execute the interior corners of a cementious surface without surface blemishes or groove marks.

4 Claims, 2 Drawing Sheets

INTERIOR EDGE-EDGER

FIELD OF THE INVENTION

The invention relates to the construction arts and particularly to a hand tool to shape the interior or inside edge of a cement surface.

BACKGROUND OF THE INVENTION

When a mason is edging a cement surface and is required to turn a sharp interior or inside corner, it is very difficult to keep an edging tool from biting into the surface of the cement, thereby producing cuts and blemishes in the surface of the cement. Existing edging tools have a curved lip extending the entire length of the tool, which while suitable for long stretches of edging result in either a nonuniform top surface or a groove mark at the intersecting corner, unless a great deal of skill is exerted and additional tools are used.

The object of my invention is to provide a hand tool which will allow the mason to edge interior corners without surface blemishes or groove marks.

Another object of my invention is to permit those less skilled in the mason art to execute improved interior corners on cement surfaces.

SUMMARY OF THE INVENTION

The objects of my invention are achieved by providing a hand tool having a flat rectangular surface with the center portion of one of the longer edges curved downward. The curved surface provides the form for edging the cement. The reminder of this edge is configured such that the dimension of the edge on either side of the curved surface is of equal length to the adjacent leading and trailing edge. With this configuration, the mason can stop the edging process exactly at the limits of an interior intersecting corner, while simultaneously allowing the flat surface of the tool to extend over the surface of the cement. When my invention is used in a like manner on the adjacent edge of the cement surface, the mason again stops the edging process at the limits of the interior intersecting corner. Since it is not necessary for the downward curving edging surface to be extended beyond the intersection of the corner in order to achieve the desired flat surface under the front edge of the tool, the resulting corner is thereby formed without surface blemishes or groove marks.

DETAILED DESCRIPTION OF THE INVENTION

Figure 1:
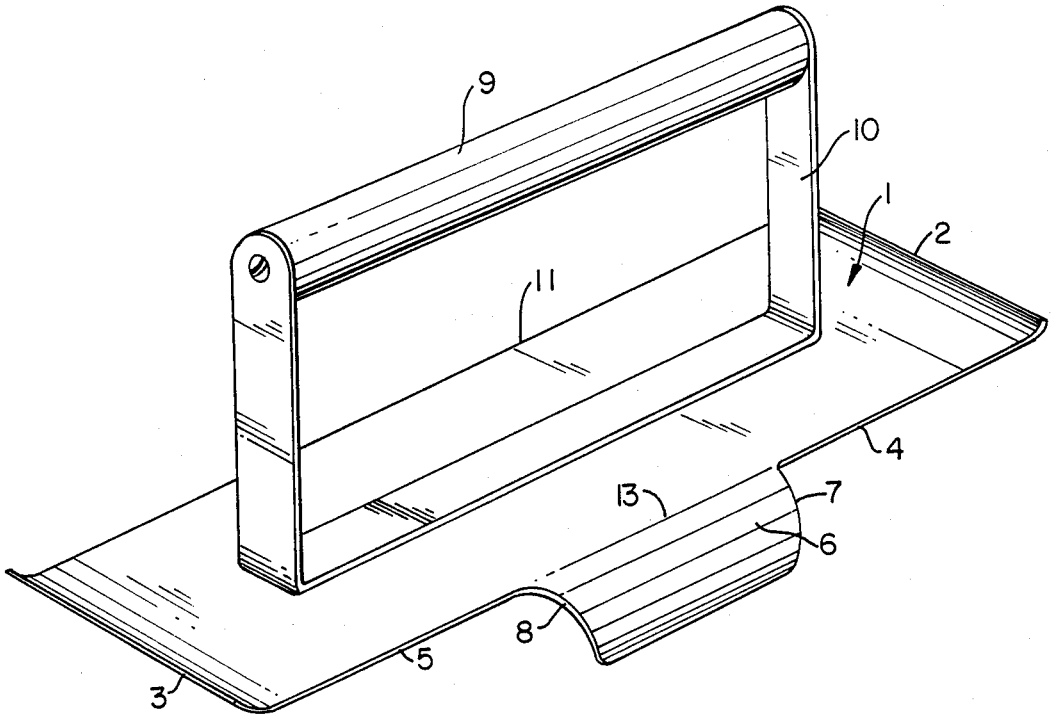
FIG. 1 is a perspective view of the invention.
Figure 2:
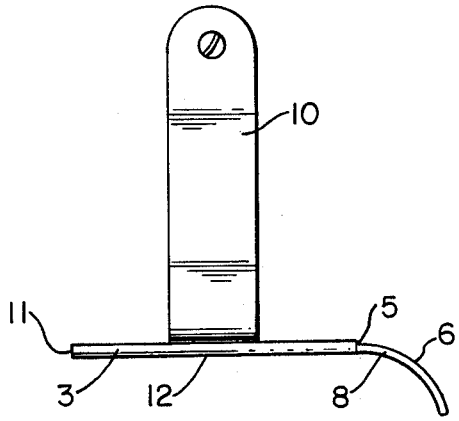
FIG. 2 is a side view.
Figure 3:
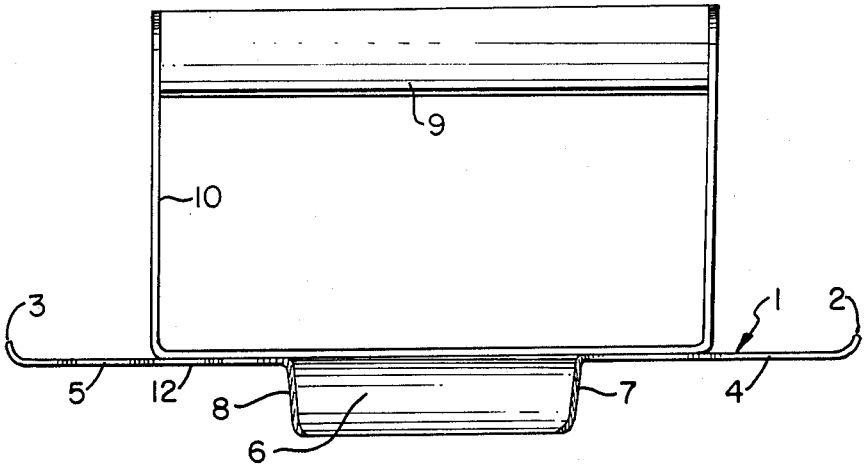
FIG. 3 is a front view.
Figure 4A:
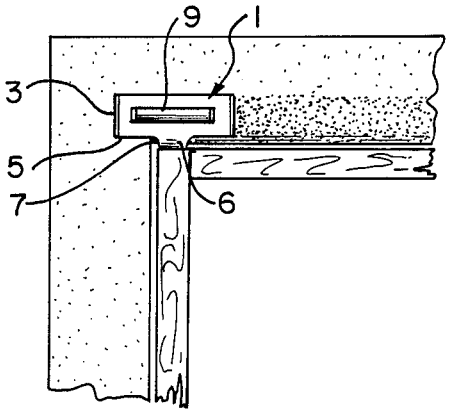
FIG. 4A is a top view of the tool illustrating the use of the tool at an interior intersecting corner of a cement surface.
Figure 5A:
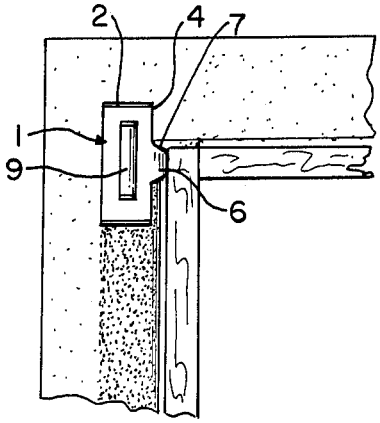
FIG. 5A is a top view of the tool illustrating its use on the corner adjacent to that shown in FIGS. 4A and 4B.
Figure 4B:
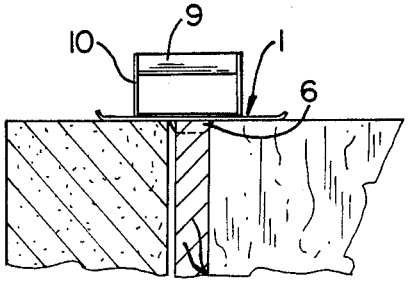
FIG. 4B is a front view of the tool in use as in 4A.
Figure 5B:
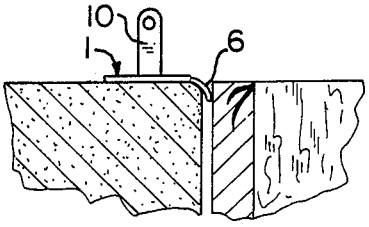
FIG. 5B is a side view of the tool in use as in 5A.

The tool consist of two main elements: the first of which is a flat inflexible rectangular plate 1, having a smooth underside 12, the leading edge 2 and trailing edge 3 of which is upwardly curved. One of the longer edges, the working edge, 13 of the plate 1, is symmetrically configured, with a central portion 6 running approximately one-third (⅓) the length of the edge, extending outward and curving downward. The other longer edge, 11 is straight-edged, except for being curved-upward at the leading and trailing edges. The curvature of the central portion 6 of the working edge is of such a radius so as to produce a suitable rounding off of the corners of a cement edge or curb. The length of the central portion 6 must be of sufficient length to keep the tool steady when moved along the surface.

The left 5 and right 4 portions of the working edge 13 is of the same length as the leading edge 2 and the trailing edge 3 of the plate. As a result of this configuration, the surface adjacent to the intersection of an interior corner of a cement surface is uniformly made flat.

The second element of the tool is a handle 9 affixed to the plate 1 by a suitable means, 10.

In use the mason guides the tool along the edge of the cement surface, with the downward curving portion of the edge 6 sliding between the vertical edge of the wet cement and a form until the leading edge of the downward curving portion of the edge 7 corresponds with the interior corner of the adjacent cement surface. The leading surface of the tool 21 causes the cement to have a flat surface. The mason will lift the tool and repeat the same operation along the adjacent edge, again until the leading edge of the downward curving portion of the edge 6 corresponds with the interior corner of the adjacent cement surface. Since the dimension of the portion of the edge adjacent, 4 and 5, to the downward curving portion 6 and the leading edge 2 are of equal length, the intersecting flat surfaces will completely overlap, resulting in a non-blemished surface; and since it is no longer necessary for the mason to run the tool beyond the corner there will be no groove marks.

I claim:

1. A hand tool for forming the interior edge of a cementious material, comprising:

(a) a flat inflexible rectangular plate, the center portion of one of the longer edges of which is extended outward and downward curved, the two outer remaining portions of said edge being of the same dimension as the leading and trailing adjacent edges, said adjacent leading and trailing edges curving upward;

(b) a handle; and (c) means for connecting handle to the top of said plate.

2. The hand tool of claim 1 in which said plate is fabricated of 18 to 20 gauge sheet metal.

3. The hand tool of claim 1 in which said plate is formed of cast iron.

4. The hand tool of claim 1 in which said plate is formed of cast aluminum.

* * * * *